United States Patent [19]

Suzuki et al.

[11] 4,300,958

[45] Nov. 17, 1981

[54] SEMI-HARD MAGNETIC MATERIAL FOR A REED SWITCH AND PROCESS FOR PRODUCING THE SAME

[75] Inventors: Yuichi Suzuki, Zushi; Masanori Okada, Yokohama; Zenzo Henmi, Kawasaki, all of Japan

[73] Assignee: Fujitsu Limited, Kawasaki, Japan

[21] Appl. No.: 165,990

[22] Filed: Jul. 7, 1980

Related U.S. Application Data

[63] Continuation of Ser. No. 964,515, Nov. 29, 1978, abandoned.

[30] Foreign Application Priority Data

Nov. 29, 1977 [JP] Japan ..... 52-142147

[51] Int. Cl.[3] ..... H01F 1/00

[52] U.S. Cl. ..... 148/120; 148/31.55; 75/170; 335/93

[58] Field of Search ..... 148/31.55, 120, 102, 148/121; 75/170; 427/127; 335/93

[56] References Cited

U.S. PATENT DOCUMENTS 3,983,916 10/1976 Henmi et al. ..... 148/120

3,989,557 11/1976 Henmi et al. ..... 148/120

*Primary Examiner*—L. Dewayne Rutledge

*Assistant Examiner*—John P. Sheehan

*Attorney, Agent, or Firm*—Staas & Halsey

[57] ABSTRACT

Due to an Mo addition, to a known Co-Fe-Nb semi-hard magnetic material, the coercive force is enhanced without causing deterioration of the cold workability of the semi-hard magnetic material. In addition, the energy product, the residual flux density and the fullness factor are high according to the semi-hard magnetic material of the present invention. Such material is particularly suited for reed pieces of reed switches, which are mounted in a four wire crosspoint switch.

31 Claims, 21 Drawing Figures

SEMI-HARD MAGNETIC MATERIAL FOR A REED SWITCH AND PROCESS FOR PRODUCING THE SAME

This is a continuation of application Ser. No. 964,515 filed Nov. 29, 1978, abandoned.

BACKGROUND OF THE INVENTION

1. Field of the Invention

The present invention relates to semi-hard magnetic materials, which are suited for reed pieces of a self-holding type reed switch, as well as a process for producing the semi-hard magnetic materials.

2. Description of the Prior Art

Such materials should possess a hysteresis loop shape and a residual magnetization property suited for application in a self-holding type reed switch. Specifically, the semi-hard magnetic materials utilized in a reed switch should preferably possess the following properties.

1. Both saturated magnetic flux density (Bs) and residual magnetic flux density (Br) are high.

2. The hysteresis loop exhibits a high squareness ratio (Br/Bs) and a high "fullness factor". The term "fullness factor" used herein is represented by the formula $$\sqrt{(BH)\max/Br \cdot Hc}$$

wherein (BH)max is the maximum magnetic energy product and Hc is the coercive force.

3. The coercive force (Hc of magnetic materials) is usually in the range between 10 and 50 Oe, but the coercive force should be more than 50 Oe for application of semi-hard magnetic materials to reed switches where mutual demagnetization, explained hereinafter, is severe.

4. Plastic workability is excellent, i.e. these materials are capable of being easily cold worked into any desired shape or size such as, for example, a fine wire rod having a diameter as small as less than 1 mm.

5. The plating or soldering property is excellent, i.e. a surface layer on the semi-hard magnetic materials used for forming a reed switch can be reliably produced by a plating or soldering process.

6. When the semi-hard magnetic materials are exposed to a high temperature, at the time of sealing the reed pieces having the above mentioned surface layer in a glass capsule of the reed switch, the magnetic properties of the reed pieces are not deteriorated by the increase of temperature.

When the reed switches are used in a four-wire crosspoint switch matrix of an electronic switching system, mutual demagnetization occurs between the four reed switches. As a result of the demagnetization, the coercive force and the squareness ratio of the semi-hard magentic materials must be higher than in the reed-switches used in a two-wire crosspoint switch of an electronic switching system.

In U.S. Pat. No. 3,989,557, filed by the present inventors, there is described a process for producing a semi-hard magnetic material, wherein an alloy material comprising from 73 to 93% of cobalt, from 1 to 5% of niobium and iron in balance is subjected to (1) a process annealing at a temperature of 900° or higher, and subsequently, (2) a final cold working at a reduction of area of 75% or higher. The same U.S. patent also describes a process for producing a semi-hard magnetic material, wherein the alloy material, which is cold worked as stated above, is further subjected to aging at a temperature of 600° to 900° C. and higher. The semi-hard magnetic material, in the U.S. patent mentioned above, however, is disadvantageous in the fact that the cold working property thereof is deteriorated by the increase of the niobium content in the range of from 1 to 5%, although the coercive force of the semi-hard material is increased by such increase of niobium. In addition, deterioration of cold-workability is particularly remarkable when an attempt is made to increase niobium to more than 5%.

The alloy material of the U.S. Patent mentioned above may contain, for example, tantalum, titanium, vanadium, zirconium, molybdenum, chromium, tungsten and the like. The amount of these metals used in addition to niobium is usually such that the ratio by weight of these metals to niobium is less than 30/70. These metals form intermetallic compounds in the same manner as niobium forms the intermetallic compounds, according to the description in the above U.S. Pat. No. 3,989,557.

An improved process for preventing the deterioration of the cold workability is proposed in U.S. Pat. No. 3,983,916 assigned to the same assignee as the present invention, wherein an alloy material comprising essentially from 73 to 93% of cobalt, from 3 to 7% of niobium and iron in balance is subjected to (1) a solution treatment, i.e. a heating at a temperature of 1000° C. or higher followed by a rapid cooling through at least the temperature range between 800° C. and 500° C., then, (2) a cold working at a reduction area of 75% or more, and subsequently, (3) an aging at a temperature in the range from 500° to 900° C. The present inventors investigated further in detail the improved process mentioned above and realized that this process involves the following problem, although the cold workability of the semi-hard magnetic material is in fact enhanced to some extent by the improved process. First, unless the bar or wire of the semi-hard magnetic is carefully drawn in the cold drawing process, the bar or wire is liable to rupture. Second, the cold workability of the semi-hard magnetic material is seriously degraded, to such an extent that the cold working cannot be practiced industrially, when an attempt is made to provide the material with a coercive force higher than 40 Oe. In the semi-hard magnetic material mentioned above as containing 3 to 7% of niobium, the Nb content and Fe content must be increased to 5% or higher and 18% or higher, respectively, to produce the result that the coercive force is increased more than 40 Oe, but the cold workability is deteriorated. It is, therefore, practically impossible to obtain from the Co-Fe-Nb alloy material, a semi-hard magnetic material having a coercive force of from 40 to 70 Oe and which is suited for the reed switches to be mounted in a four-wire crosspoint switch matrix of an electronic switching system.

A semi-hard magnetic material having a high coercive force is available under the name of VACOZET 655, which is sold by the VACUUMSCHMELZE Company, in the Federal Republic of Germany. This semi-hard magnetic material comprises 30% iron 10.6% nickel, 1.2% aluminum, 2.4% titanium and cobalt in balance. Since the magnetic properties of this semi-hard magnetic material are unstable, with the result that, for example, the coercive force is reduced by heat, the material is not suitable for reed pieces, which are sealed or enclosed in a glass capsule of a reed switch. In addition, since the semi-hard magnetic material of VACOZET 655 includes aluminum as well as titanium, the plating and soldering properties of the material are not superior to those of the Co-Fe-Nb alloy.

SUMMARY OF THE INVENTION

It is, therefore, an object of the present invention to provide a semi-hard magnetic material for reed pieces of a reed switch, which possess the properties 1 through 6, mentioned above, and specifically, a high coercive force and an excellent cold workability.

It is another object of the present invention to improve a semi-hard magnetic material for reed pieces of a reed switch, containing mainly cobalt, and additionally iron and niobium, as well as one additive element which can form an intermetallic compound, so that the cold workability is not deteriorated with an enhancement of the coercive force.

It is further object of the present invention to provide a semi-hard magnetic material suited for the reed pieces of reed switches, which are mountd in each crosspoint of the four wire type crosspoint in an electronic exchange system.

It is also an object of the present invention to prevent the rupture of the reed pieces during the cold working of the reed pieces of a reed switch and to enhance the coercive force of the produced reed pieces.

In accordance with the objects of the present invention, there is provided a semi-hard magnetic material for reed pieces of a reed switch, wherein the material contains (a) mainly cobalt and iron, which forms a matrix of the material having a face centered cubic lattice, (b) additionally niobium, which niobium is precipitated in the matrix as intermetallic compounds and provides the material with the required coercive force, and (c) molybdenum added into the material in an amount not less than 2%, so that the matrix is composed of the face centered cubic lattice and a body centered cubic lattice. Due to the composition of the matrix, the coercive force is increased to a value of not less than 35 Oe, preferably from 40 to 70 Oe, and more preferably from 60 to 70 Oe. The components of the material are adjusted so that:

the iron ranges from 12 to 18%;

the niobium ranges from 2 to 4%;

the molybdenum ranges from 2 to 5%; and the cobalt is essentially the balance, thereby providing the material with a residual magnetization flux density of not less than 11 and preferably 13 kGauss and a fullness factor of not less than approximately 0.80.

In accordance with the objects of the present invention, there is also provided a process for producing reed pieces of a reed switch from a semi-hard magnetic material containing mainly cobalt and iron, and additionally niobium and molybdenum, comprising the steps of:

forming said material to comprise molybdenum in amount from 2 to 5%, iron in an amount ranging from 12 to 18%, niobium in amount ranging from 2 to 4%, and cobalt for the balance; solution-treating the material;

cold working the solution treated material at a reduction of area of at least 90%, and due to the molybdenum addition, (a) maintaining the hardness of said cold worked material at a value not exceeding 450 on the Vickers scale, (b) preventing the decomposition of the cobalt-rich phases of the face centered cubic lattice into two different phases during said cold working, and (c) preventing the rupture of the material during the cold working; and aging the cold worked material at a temperature of from 600° to 750° C. preferably from 600° to 700° C., and thereby decomposing said matrix phases into (a) the phases of intermetallic compounds precipitated in the matrix of the aged material, (b) the original matrix phases of said face centered cubic lattice and (c) the new matrix phases of a body centered cubic lattice, and also, providing the semi-hard magnetic alloy with a coercive force not less than 35 Oe, preferably from 40 to 70 Oe, more preferably from 60 to 70 Oe, a residual magnetization flux density of not less than 11, preferably 13 kG, and a fullness factor of not less than approximately 0.80.

The basic component of the semi-hard magnetic material according to the present invention is cobalt, which is contained therein in an amount of from 73 to 93%, preferably from 75 to 81%. When the cobalt content is less than 73%, the alloy material is so hard that the workability thereof is deteriorated. As a result, both the squareness ratio and the fullness factor of the semi-hard magnetic material are disadvantageously reduced.

The alloy material according to the present invention exhibits at the solution treated state a face centered cubic lattice, because this alloy material mainly contains cobalt and iron. However, when the cobalt content is less than 73%, a part of the alloy material crystals having the face centered cubic lattic is transformed into a body centered cubic lattice during the cold working, with the result that the plastic workability of the cobalt based alloy material is reduced. When the cobalt content exceeds 93%, the workability of the alloy material is also reduced. This is because a part of the alloy mateial crystals having the face centered cubic lattice is transformed into a hexagonal close packed lattice, with the result that the plastic workability of the cobalt based alloy material is reduced. In addition, when the cobalt content exceeds 93%, the content of molybdenum, iron and niobium are relatively reduced, and thus, the magnetic properties of the semi-hard magnetic material are disadvantageously degraded.

The niobium provides, in combination with molybdenum, a semi-hard magnetic material with the required coercive force. When the niobium content is less than 2%, the coercive force is too low. On the other hand, when the niobium content exceeds 4%, the workability of the cobalt based alloy material is degraded. With an increase of the niobium content, intermetallic compounds containing niobium tend not to be dissolved, and thus, remain in the cobalt matrix after the solution treatment of the cobalt based alloy material.

The iron provides the semi-hard magnetic material with the required, coercive force, saturation flux density and residual magnetization. When the iron content is less than 12%, the coercive force, saturation flux density and residual magnetization are too low. When the iron content exceeds 18%, the cold workability of the cobalt based alloy material is reduced. The iron content is therefore from 12 to 18%.

If the semi-hard magnetic material consists only of cobalt, iron and niobium, the cold workability thereof is deteriorated when an attempt is made to increase the coercive force thereof by adjusting the niobium content. The feature of molybdenum resides in the fact that the coercive force is enhanced but the cold workability is not deteriorated substantially. The molybdenum content of 2% or more is essential for sharply increasing the coercive force. When the molybdenum content exceeds 5%, the residual magnetization is however, lowered.

The process for producing the semi-hard magnetic material according to the present invention includes the conventional steps of melting the raw materials for obtaining the alloy material, casting the melt into an ingot, hot-working the ingot, solution-treating the hot-worked alloy material, cold working, and subsequently, aging the alloy material. In the melting step, the conventional raw materials, such as an electrolytic cobalt, an electrolytic iron, a ferromolybdenum metal and a ferroniobium metal, are melted in a high frequency, induction furnace, preferably in a vacuum, high frequency, induction furnace. The obtained melt is cast into a mold to produce an ingot, and the ingot is subjected to a homogenizing annealing. The ingot is then worked by a hot swaging machine, a cold swaging machine and a cold drawing machine, thereby producing a wire, a tape or a small bar. Any conventional process for producing the wire etc., can be employed in producing the semi-finished product of semi-hard magnetic material.

The semi-finished product mentioned above is heated at a temperature of from 1050° to 1200° C., preferably from 1050° to 1150° C., and should subsequently be rapidly cooled. The semi-finished product may then be subjected to a peeling by the dies, if necessary.

The process according to the present invention is characterized in that: (1) the cold working is performed at a reduction of area of at least 90%, and, due to the molybdenum selection, (a) the hardness of the cold worked material is maintained at a value not exceeding approximately 450 on the Vickers scale, (b) the decomposition of a cobalt rich phase of a face centered cubic lattice into two different phases is prevented during the cold working, and (c) the rupture of the material during the cold working is prevented; and; (2) the cold worked material is aged at a temperature of from 600° to 700° C., and by the aging, the cobalt-rich matrix phases are decomposed into (a) the phases of intermetallic compounds precipitated in the matrix of the aged material, (b) the original matrix phases of the face centered cubic lattice, and (c) the new matrix phases of a body centered cubic lattice, and also, the semi-hard magnetic alloy is provided with a coercive force not less than 35 Oe, preferably from 40 to 70 Oe, more preferably from 60 to 70 Oe, a residual magnetization flux density of not less than 11 kG and a fullness factor of not less than approximately 0.80.

The semi-hard magnetic material according to the present invention, which consists of the Co-Fe-Nb-Mo alloy, can be used for the reed pieces of a reed switch, on which pieces a surface coating, for example a rhodium plating, must be applied. Since this semi-hard magnetic material contains neither titanium nor aluminum, the surface coating is uniform and exhibits a high adhesive strength.

The surface coating process includes the following steps. In the preparatory step prior to the applying step of the coating, the reed pieces, which were previously aged for exampled at 650° C., are boiled in a 5% caustic alkaline solution at a temperature of 100° C. for about 20 minutes, or subjected to an electrolytic polishing, thereby removing an oxide film composed mainly of niobium oxide. An underlying layer, such as a gold striking layer, may be deposited on the reed pieces, so as to increase the bonding strength of the desired coating to the reed pieces. Also a lower, coating metallic layer, such as a tin layer, may be firstly formed on the underlying layer to a thickness of approximately 0.5 micron, and subsequently, the rhodium plating layer is formed to a thickness of from 2.0 to 4.0 microns.

BRIEF DESCRIPTION OF THE FIGURES

The present invention is explained in detail hereinafter with reference to the drawings, wherein.

DESCRIPTION OF THE PREFERRED EMBODIMENTS

The semi-hard magnetic material according to the present invention is characterized, as compared with that consisting of Co-Fe-Nb, by exhibiting a high coercive force of not less than 35 Oe, preferably from 40 to 70 Oe, more preferably from 60 to 70 Oe, a residual magnetization flux density of not less than 13 kG and a fullness factor of not less than approximately 0.80. In addition the energy product $(BH)_{max}$ ranges advantageously from 0.3 to 0.6 M G.Oe.

A measurement of the resistivity and X-ray diffractometry were carried out with regard to the alloy materials of Co-15%Fe-4%Nb-2–5%Mo, which were firstly formed in the form of a coil having a 2 mm diameter and, then, drawn to a size of 0.6 mm after being solution treated at 1100° C. The drawn coil was subjected to aging at a temperature up to 1000° C. and, then, resistivity measurement and X-ray diffractometry were carried out. The results of such measurement and X-ray diffractometry are shown in FIG. 1.

Figure 1:
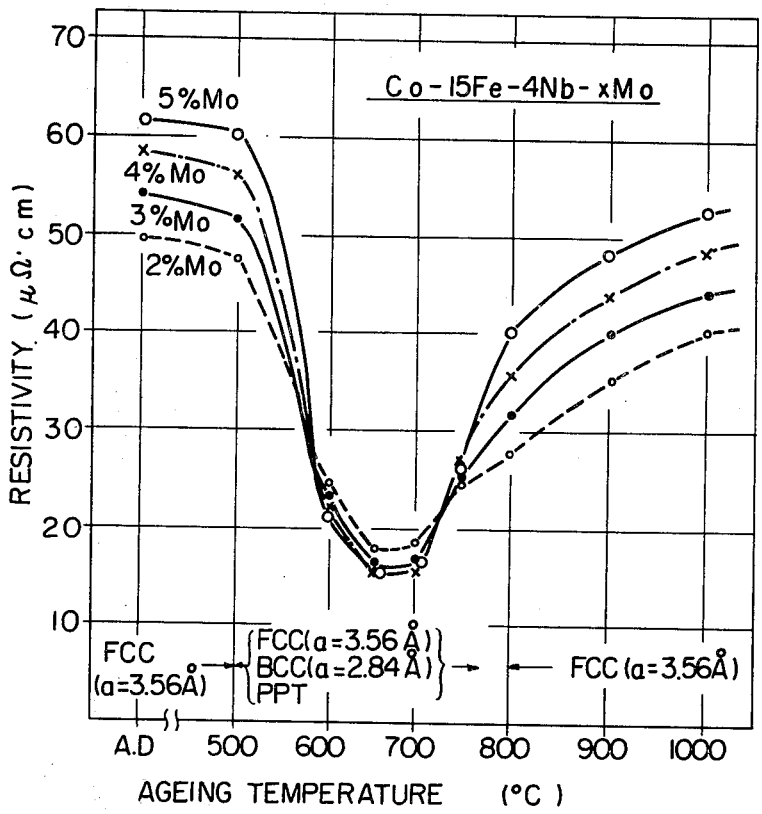
FIG. 1 is a graph indicating the change of resistivity with aging temperature of Co-15%Fe-4%Nb-xMo alloy materials.

The following facts will be apparent from FIG. 1. (1) The decrease of resistivity starts from 500° C. (2) The resistivity a minimum at a temperature of from 650° to 700° C. (3) The resistivity is increased from a temperature higher than 700° C. (4) The alloy materials exhibit at a drawing state (A.D.) a crystal structure of a face centered cubic (FCC) lattice with a lattice constant (a) of 3.56 angstroms. (5) The face centered cubic phases of the alloy material at the drawing state are decomposed into the new phases of the body centered cubic (BCC) lattice and precipitates (PPT), as well as the original face centered cubic (FCC) phases, while the resistivity is decreased during the decomposition. (6) Only the face centered cubic (FCC) phases are present at a temperature of 800° C. and higher.

It was proven by the X-ray diffractometry of the alloy materials that the face centered cubic phases and the body centered cubic phases are a solid solution of cobalt, and the iron is dissolved in the solid solution. The composition of the precipitated phases are not elucidated but are believed to be the intermetallic compounds of $Co_3Nb$ and $Co_3Mo$.

From the facts revealed from FIG. 1, it will be apparent that several features of the present invention reside in the structure of the alloy materials. The increase of coercive force by aging at a temperature of from 600° to 750° C. is caused not only by a precipitation of the intermetallic compounds into the cobalt matrix, as in the case of the known Co-Fe-Nb alloy, but also by a decomposition of the cobalt matrix into the FCC phases and BCC phases. Such decomposition of the cobalt matrix into two kinds of phases is believed to cause the remarkable increase of the coercive force, which increase is achieved when the molybdenum is added in an amount of at least 2%. When the matrix of any metallic material is composed of the two kinds of mixture phases, the cold workability thereof is impaired thereby. In addition, the decomposition of the matrix is liable to occur even during the cold drawing in the case of the known Co-Fe-Nb alloy material. However, according to one of the features of the invention, the cobalt matrix is not decomposed due to the Mo addition during the cold working, and thus the cold workability of the alloy materials is advantageously not improved.

Figure 2:
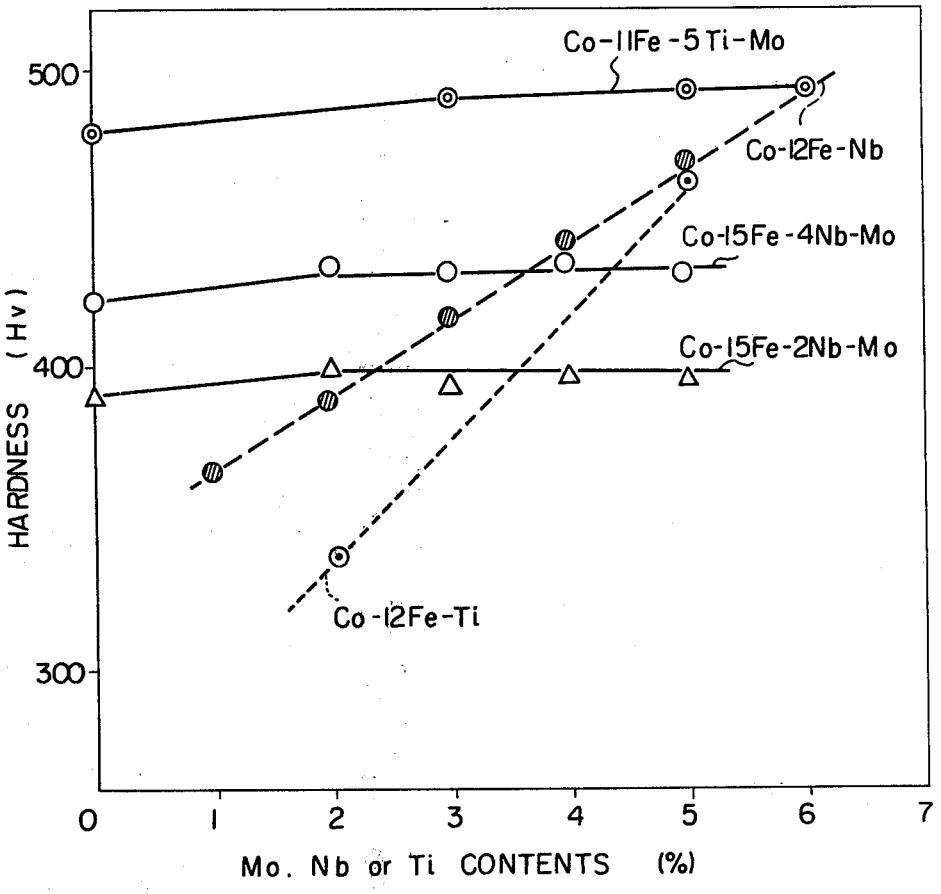
FIG. 2 is a graph indicating the relationship of the hardness after drawing with regard to the contents of additional elements added to several cobalt-based alloys.

In FIG. 2, the hardness after drawing is shown with regard to the several cobalt-based alloys. The lines —Δ— and — — represent the alloy of Co-15%Fe-2%Nb-x%Mo and the alloy of Co-15%Fe-4%Nb-x%Mo, according to the present invention, respectively. The line — — represents the alloy of Co-12%Fe-x%Ti, the line — — represents the alloy of Co-12%Fe-x%Nb, and the line — — represents the alloy of Co-11%Fe-5%Ti-x%Mo. All the alloys were cold drawn at a reduction of area of 90%. From FIG. 2, the influence of the additional element, i.e. molybdenum, niobium or titanium, on the work hardening of Co-Fe alloys is apparent.

The molybdenum content exerts substantially no influence on the hardness of the Co-Fe alloy materials (c.f. the lines —Δ—, — — and — —). In the alloys represented by these three lines, the alloy of Co-11%Fe-5%Ti-x%Mo has the highest hardness, while the other two alloys have an advantageously low hardness of not exceeding 450 on the Vickers scale. When the titanium or niobium content is increased, the hardness is also proportionally increased (the line — — or — ).

In Table I, below, the cold workability, the coercive force (Hc in Oe) and the saturation flux density ($B_{100}$ in kG) are shown with regard to the known, Co-Fe-Nb alloys disclosed in U.S. Pat. No. 3,989,557. These alloys were produced using the same procedure as in Example 1, illustrated hereinbelow. Since the difficulty in the workability cannot be quantitatively expressed, it is expressed in the three levels A, B and C, wherein the level A indicates that the alloy material could be worked into a wire having diameter of 0.6 mm (reduction of area of 91%), the level B indicates that the wire was frequently ruptured during the drawing to the size of 0.6 mm, and the level C indicates that the 0.6 mm wire could not be produced by the drawing. The magnetic properties in Table I are those of the wires having a diameter of 0.6 m and aged at 700° C. However, with regard to the wires of level C, the magnetic properties of the actually produced wires were measured and then calibrated, in a manner as if the change of the magnetic properties occured due to the cold drawing of the wires up to 91% of the reduction of area.

TABLE I

| | Fe (%) | | | | | |
|---|---|---|---|---|---|---|
| Nb (%) | 6 | 9 | 12 | 15 | 18 | 21 |
| 7 | — | — | C<br>Hc 48<br>$B_{100}$ 11 | — | — | — |
| 6 | | | A<br>Hc 36<br>$B_{100}$ 13.6 | B<br>Hc 42<br>$B_{100}$ 14 | | |
| 5 | — | — | A<br>Hc 35<br>$B_{100}$ 14.2 | B<br>Hc 36<br>$B_{100}$ — | C<br>39.5 | |
| 4 | A<br>Hc 27.4<br>$B_{100}$ — | A<br>Hc 26.0<br>$B_{100}$ — | A<br>Hc 28<br>$B_{100}$ 15.5 | A<br>Hc 34<br>$B_{100}$ 15.8 | A<br>Hc 36<br>$B_{100}$ 16.0 | C<br>Hc 37<br>$B_{100}$ — |
| 3 | A<br>Hc 17.2<br>$B_{100}$ — | A<br>Hc 18.8<br>$B_{100}$ — | A<br>Hc 22<br>$B_{100}$ 15.8 | A<br>Hc 24<br>$B_{100}$ 15.8 | A<br>Hc 27<br>$B_{100}$ 16.0 | A<br>Hc 28<br>$B_{100}$ 17.1 |

It is apparent from Table I, that the cold workability of the alloy materials exhibiting a coercive force more than 36 Oe is B or C. The cold workability is deteriorated with an increase in the niobium and iron contents. Although either the high coercive force or the excellent cold workability must be sacrificed in the known alloy materials consisting of cobalt, iron and niobium, both the required, coercive force and cold workability can be achieved by the addition of molybdenum to this alloy material. According to one of the features of the present invention, the frequency of rupture of the wire during the cold drawing is considerably decreased in the present invention as compared with that in the cold drawing of the known alloy material of Co-Fe-Nb. The alloy material according to the present invention can be drawn at a reduction of area of at least 90% without the wire rupturing. Although the wire according to the known alloy of Co-Fe-Nb is broken into more than three pieces, the wire according to the present invention is not broken during drawing, even if both wires are drawn under the same drawing conditions.

Figure 3:
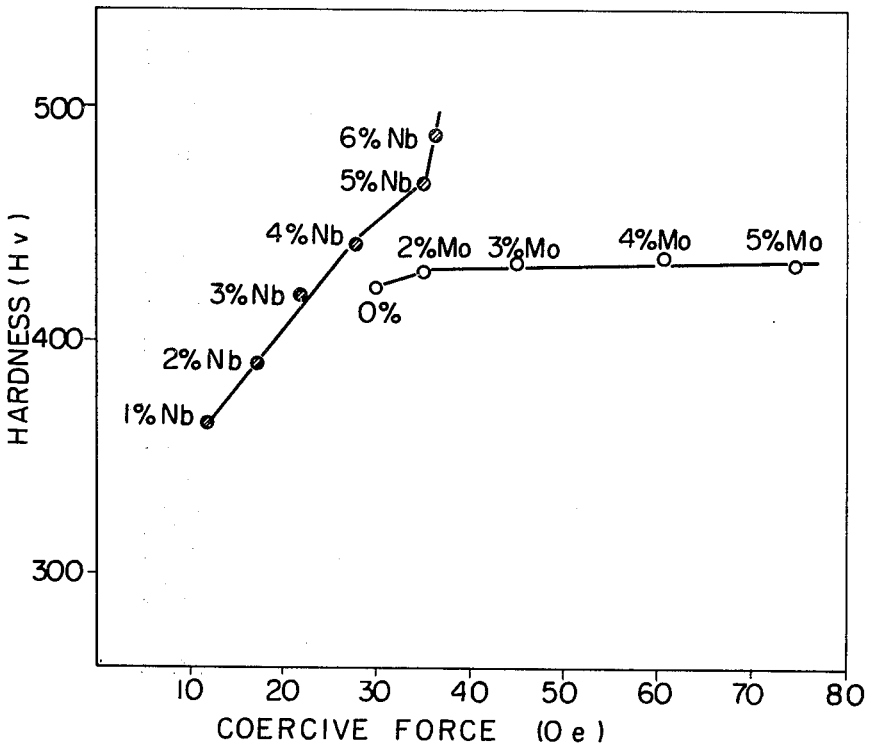
FIG. 3 is a graph indicating the relationship of the hardness after drawing with regard to the coercive force of two cobalt-based alloys.

The hardness after cold drawing is the result of the work hardening and is a factor which influences the cold workability of any metallic material. The relationship between the cold workability and the coercive force of the cobalt based alloy materials is readily seen in FIG. 3. In FIG. 3, the line — — represents the known alloy material of Co-12%Fe-x%Nb, which is cold drawn at a reduction of area of 90% (except for 65% of the alloy containing 6%Nb) and which is aged at 700° C. for the period of 1 hour. The alloy material of Co-12%Fe-6%Nb could not be cold drawn at a reduction of area of 90%. The line — — represents the alloy materials according to the present invention, which consists of Co-15%Fe-4%Nb-x%Mo. These alloy materials were drawn at a reduction of area of 90% and the hardness of the alloy materials after the cold drawing was measured. The cold drawn alloy materials were then aged at 650° C. for the period of 1 hour. The known alloy materials exhibit the increase of coercive force with an increase in the hardness after drawing, i.e. a deterioration of the cold workability. In other words, due to the precipitation of intermetallic compounds containing niobium, the coercive force is increased, while the intermetallic compounds containing niobium, which are left undissolved in the cobalt matrix, reduce or impair the cold workability of the known alloy of Co-Fe-Nb. On the other hand, in the alloy materials according to the present invention, the coercive force is advantageously increased from 35 to 75 Oe, while the hardness after drawing is kept essentially constant. This fact means that the amount of the intermetallic compounds, which are supposed to contain molybdenum, in addition to niobium, is not changed regardless of the increase of the coercive force. The difference between the two lines in FIG. 3 implies, therefore, that in the alloy materials of the present invention, the increased coercive force in the range from 35 to 70 Oe is caused mainly due to the decomposition of the cobalt matrix into the new body centered cubic (BCC) phases and the original face centered cubic (FCC) phases, explained in connection with FIG. 1. In other words, the precipitation of the intermetallic compounds does not have a major role in such increase of the coercive force.

Figure 4:
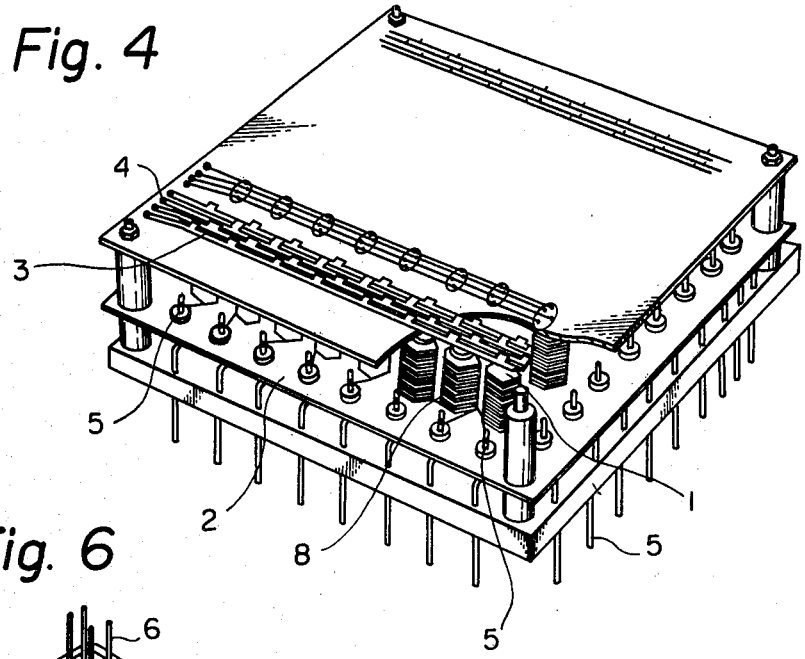
FIG. 4 is a general view of a four wire crosspoint switch.

Referring to FIG. 4 a coil form 1 contains a plurality of reed switches which are used as crosspoint switches, and outside of each 1, a driving coil 8 which drives the above-mentioned reed switch 1 is wound. A magnetic shunt plate 2 is composed of magnetic material and provides a plurality of holes for arranging the above-mentioned coil forms 1 in a matrix array. Horizontal and vertical multiple connecting wires 3 and 9, shown in FIG. 5, connect the lead terminals 6 of the reed switches held in the coil forms 1 with the output terminals of the circuits of the speech path. Said multiple connecting wires 3 and 9 are composed of high permeability magnetic material and are capable of relieving the prominent demagnetizing effect between reed switches. Such demagnetizing phenomenon is frequently produced when the reed switch is miniaturized.

Figure 5:
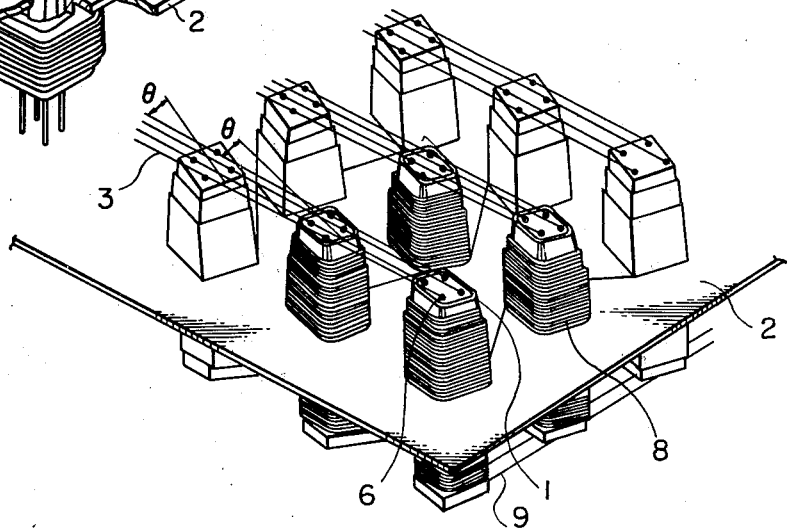
FIG. 5 is a partially enlarged view of FIG. 1.

As shown in FIG. 5, four reed switches are inserted in the respective coil forms 1 so as not to lie on the same line with respect to the longitudinal directions of the respective multiple connecting wires 3 and 9, and connected to said respective multiple connecting wires 3 and 9. Thus, the multiple connecting wires 3 and 9 are respectively arranged on the same plane in parallel, with a substantially equal distance between adjacent connecting lines.

Figure 6:
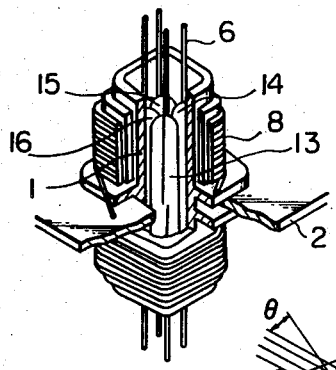
FIG. 6 is a crosspoint reed switch, in which the semi-hard magnetic material according to the present invention is used.

FIG. 6 shows the relation between the coil form 1 and the reed switches 13–15 which are contained in the bobbin 1. Referring to FIG. 6, four reed switches 13, 14, 15 and 16 are contained in the wire coil form 1, and the lead ends 6 of these reed switches are arranged in row and column directions as shown in FIG. 5, and connected with the multiple connection wires.

In the crosspoint switches as shown in FIGS. 4, 5 and 6, the hysteresis loop of the semi-hard magnetic materials of the reed switches are distorted by the mutual demagnetization effect, in such a manner that the energy product $(BH)_{max}$ of the hysteresis loop is decreased. However, since the semi-hard magnetic material according to the present invention exhibits a high coercive force, it is advantageously used for the reed switches with the four wire crosspoint switching matrix.

The present invention is explained more in detail in connection with Examples.

EXAMPLE 1

Electrolytic cobalt, electrolytic iron, ferroniobium metal and ferromolybdenum metal were charged in an alumina crucible and melted under vacuum by a high frequency induction furnace. The obtained melt was cast to produce an ingot having a diameter of 40 mm and a weight of approximately 3.2 kg. The ingot was homogenized at 1200° C. for 5 hours and subsequently worked to a wire of 2 mm in diameter by using a hot swaging machine, a cold swaging machine and a wire drawing machine. This wire of 2 mm in diameter was heated at 1100° C. for 30 to 60 minutes to carry out the solution treatment, and directly after the heating quenched in water. The so treated wire of 2.0 mm in diameter was cold drawn to the size of 0.6 mm in diameter, and the reduction of area during the cold drawing amounted to 91%. The wire could be cold drawn without occurence of rupturing. The cold workability was excellent. The cold drawn wire was subjected to an aging at a temperature lower than 1000° C. for one hour. The so produced semi-hard magnetic material contained 15% of iron, 4% of niobium, from 2 to 5% of molybdenum and cobalt in the balance.

Figure 7A:
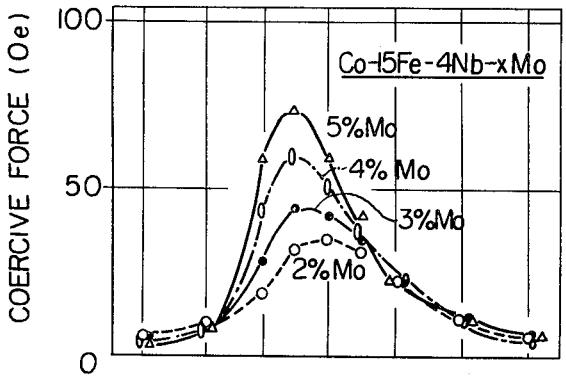
FIGS. 7A, B and C are graphs indicating the change of the coercive force, the residual flux density and the squareness ratio, respectively, as a function of the aging temperature of Co-15%Fe-4%Nb-x%Mo alloys.

The measurement results of coercive force (Hc), the residual flux density (Br), and the squareness ratio (Br/Bs, Bs designates the saturation flux density) are shown in FIGS. 7A, B and C.

Figure 7B:
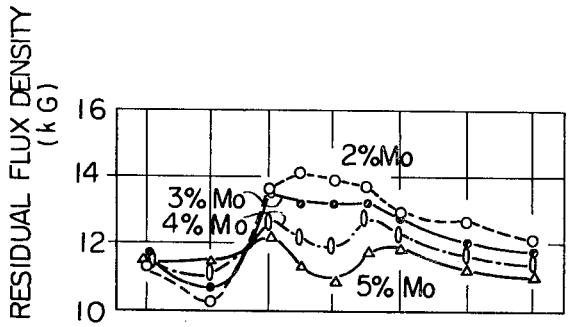

The following facts will be apparent from FIGS. 7 A, B and C. When the aging temperature is adjusted from 600° to 700° C., preferably from 630° to 660° C., (1) the coercive force is 40 Oe or more, preferably from 50 Oe or more, (2) the squareness ratio ranges from 92 to 95%, and (3) residual magnetization ranges from 11 to 14 kG. Accordingly, several properties required for the semi-hard magnetic materials are satisfied by adjusting the aging temperature. The molybdenum content should be not more than 5%, so as to provide the semi-hard magnetic material with high residual flux density.

Figure 8A:
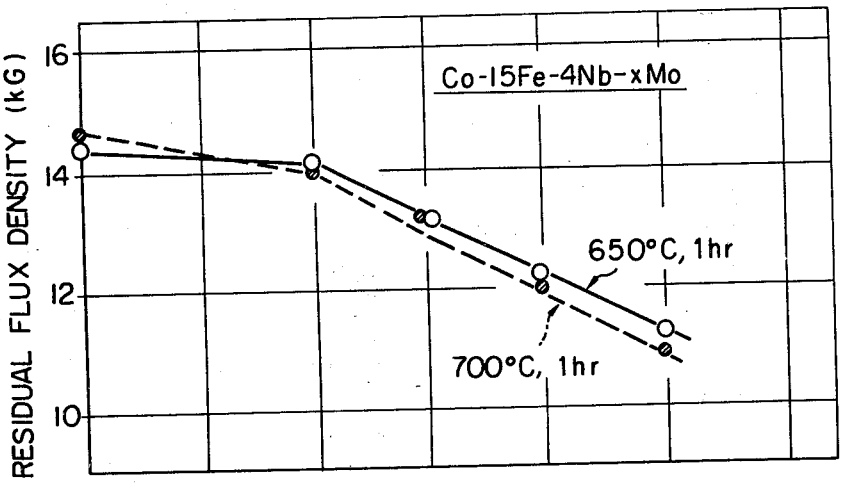
FIGS. 8A and B are graphs indicating the change in residual flux density and coercive force, respectively, of the alloy materials of FIG. 7, as a function of the molybdenum content of the alloy.
Figure 8B:
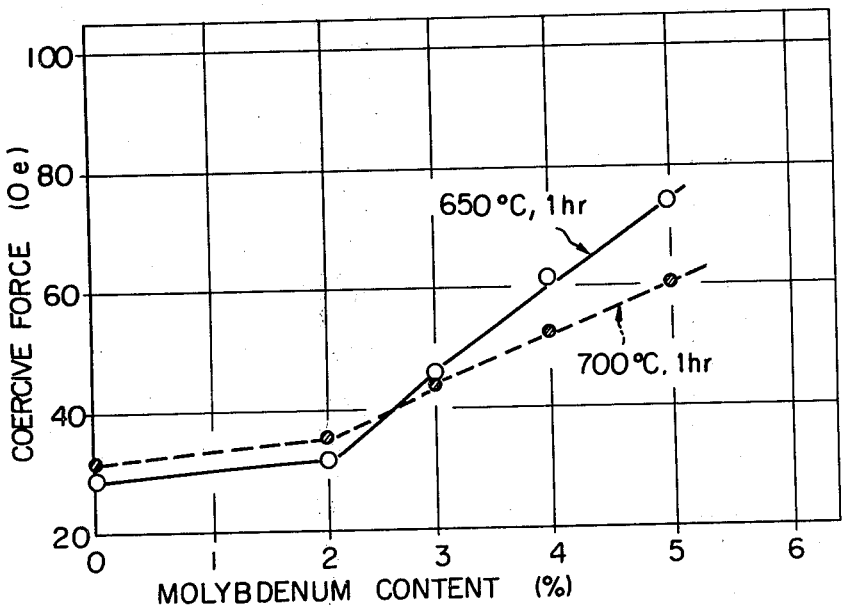

The residual flux density and coercive force measured in the present Example are shown in FIGS. 8A and B, respectively, in dependence upon the molybdenum content. As is clear from FIG. 8B, the rate of increase of the coercive force with the increase of molybdenum content is ten or more times larger at the molybdenum content of 2% or more than at the molybdenum content of less than 2%. This fact corresponds well with the difference in the crystallographic structure of the aged Co-Fe alloy materials, between the alloy materials containing 2% or more of molybdenum and those containing no molybdenum. Such difference is explained in detail in connection with FIG. 1. It can therefore be believed that that the crystallographic change of the alloy materials containing less than 2% of molybdenum is similar to that of the known, Co-Fe-Nb alloy.

EXAMPLE 2

The cobalt-based, semi-hard magnetic material containing 18% of iron, 3% of niobium and from 2 to 5% of molybdenum was produced by the procedure of Example 1.

Figure 9A:
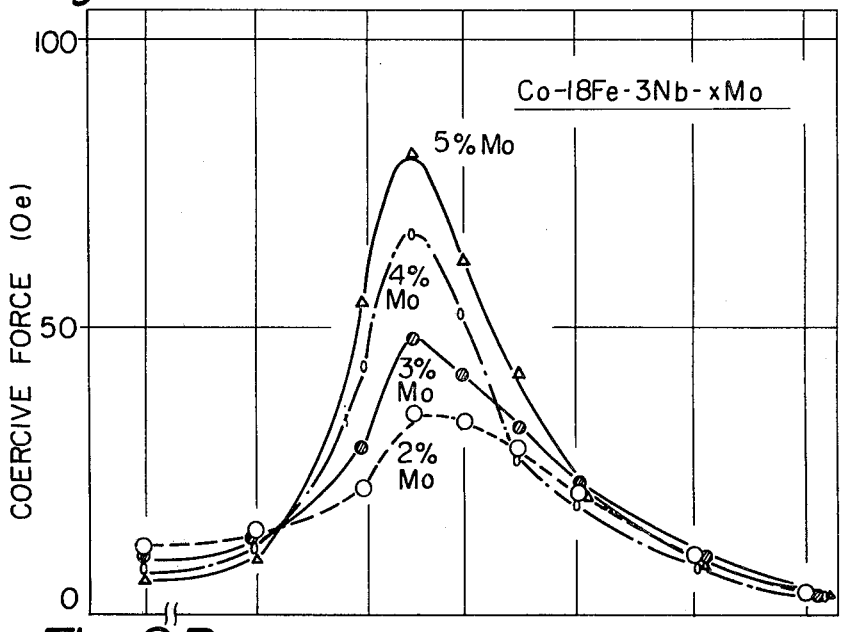
FIGS. 9A, B and C are graphs with regard to Co-18%Fe-3%Nb-x%Mo alloys similar to FIGS. 7A, B and C, respectively.
Figure 9B:
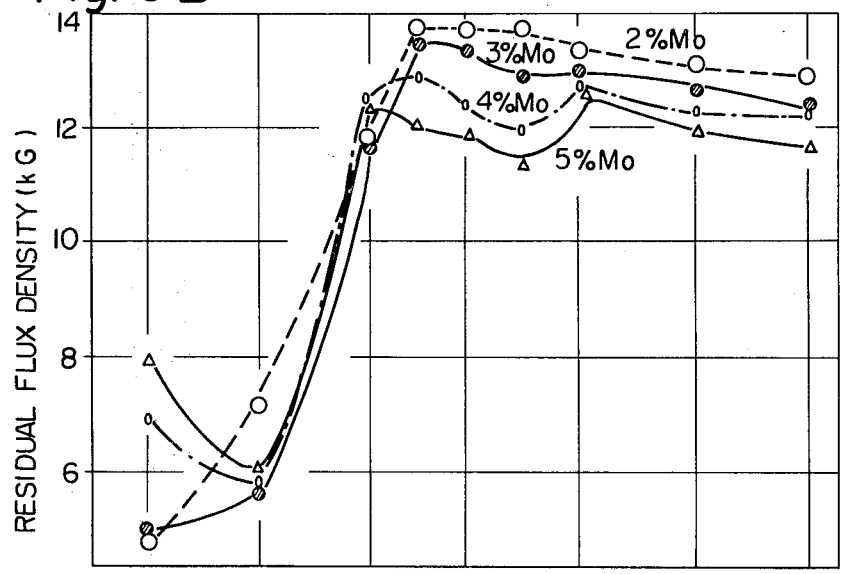
Figure 9C:
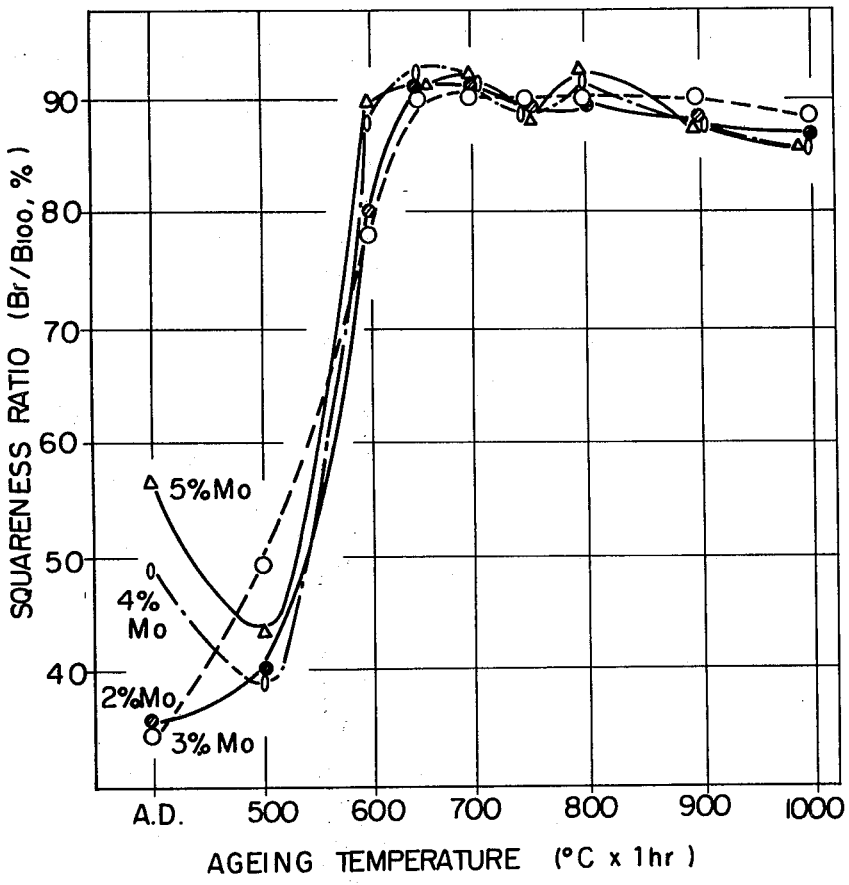

In FIGS. 9A, B and C, similar to FIGS. 7A, B and C, respectively, almost the same measured results of the coercive force, residual flux density and squareness ratio as in those of FIGS. 7A, B and C, respectively, are obtained, except for the following. The coercive force and residual flux density in FIGS. 9A and B, respectively are slightly higher than in those of FIGS. 7A and B. The squareness ratio in FIG. 9C is comparable to FIG. 7C for temperatures of 600° C. and higher.

Figure 10A:
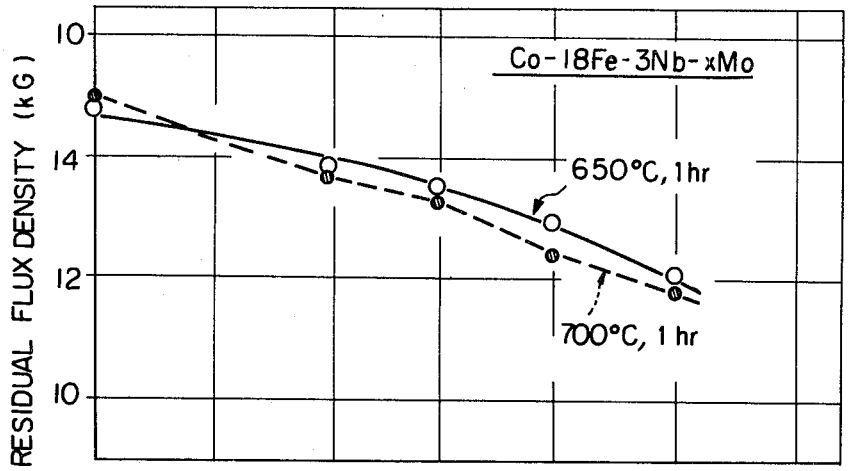
FIGS. 10A and B are graphs with regard to the Co-18%Fe-3%Nb-x%Mo alloys, similar to FIGS. 8A and B, respectively.
Figure 10B:
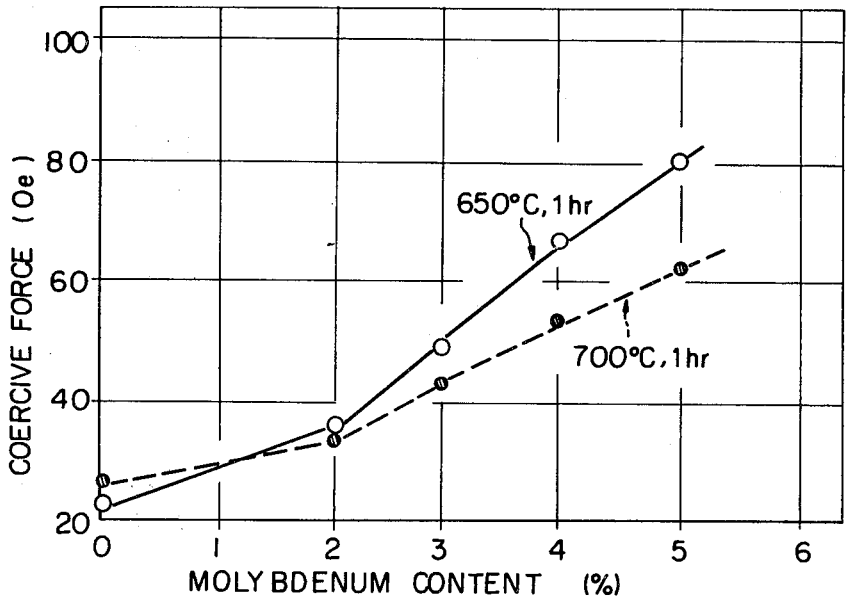

The influence of molybdenum on the residual flux density and coercive force, as seen from FIGS. 10A and B, respectively, is different from that as seen from FIGS. 8A and B in the following points. In FIG. 10A, the decrease of the residual flux density with the increase of the molybdenum content is advantageously mitigated. In FIG. 10B, the coercive force of the aged alloy materials generally slightly higher than that of the aged alloy materials in FIG. 8B containing the same amount as in FIG. 10B. These differences are advantageous from the point of view of magnetic properties, and are caused by lower niobium and higher iron content of the alloy materials in FIG. 10 than in those in FIG. 8.

EXAMPLE 3

The cobalt-based, semi-hard magnetic material containing from 12 to 18% of iron, 4% of niobium and 3% of molybdenum was produced by the procedure of Example 1.

Figure 11A:
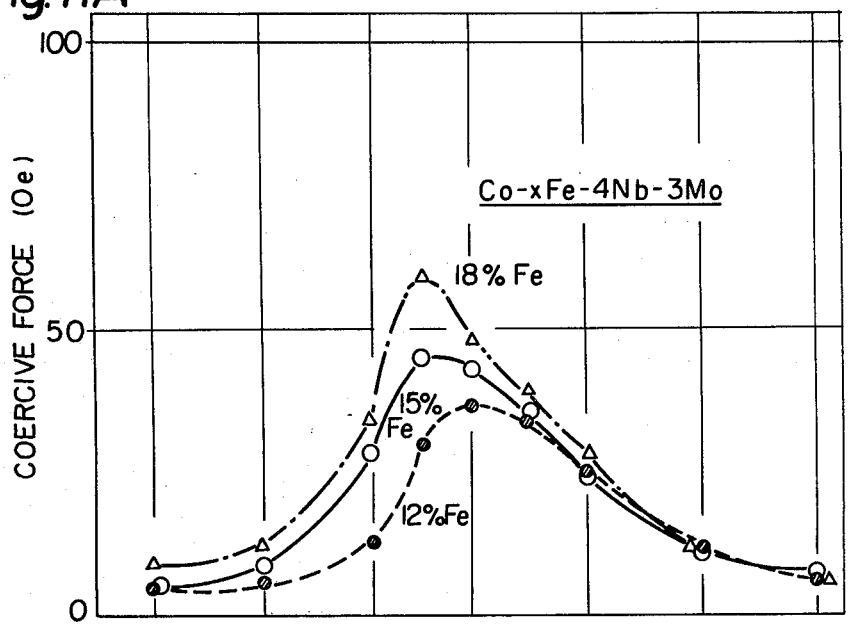
FIGS. 11A, B and C are graphs with regard to Co-x%Fe-4%Nb-3%Mo alloys, similar to FIGS. 7A, B and C, respectively.
Figure 11B:
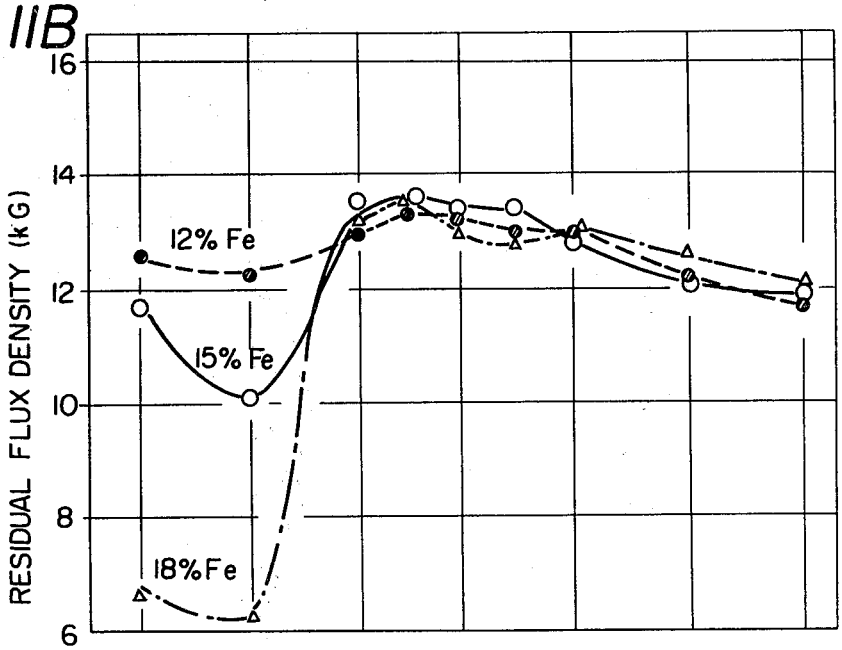

FIGS. 11A, B and C are graphs similar to FIGS. 7A, B and C, respectively.

When the alloy materials containing 18% and 15% of iron are compared with the alloy material containing 12%, of iron, the latter exhibits inferior coercive force and squareness ratio to those of the former. The iron content is therefore preferably not less than 15%, from the point of view of magnetic properties.

Figure 12A:
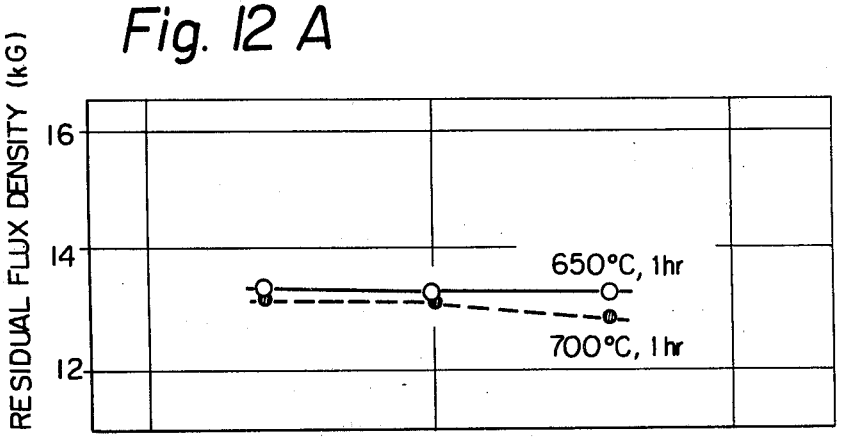
FIGS. 12A and B are graphs indicating the changes in residual flux density and coercive force, respectively, of the alloy materials of FIG. 11, with regard to the iron content of these alloy materials.
Figure 12B:
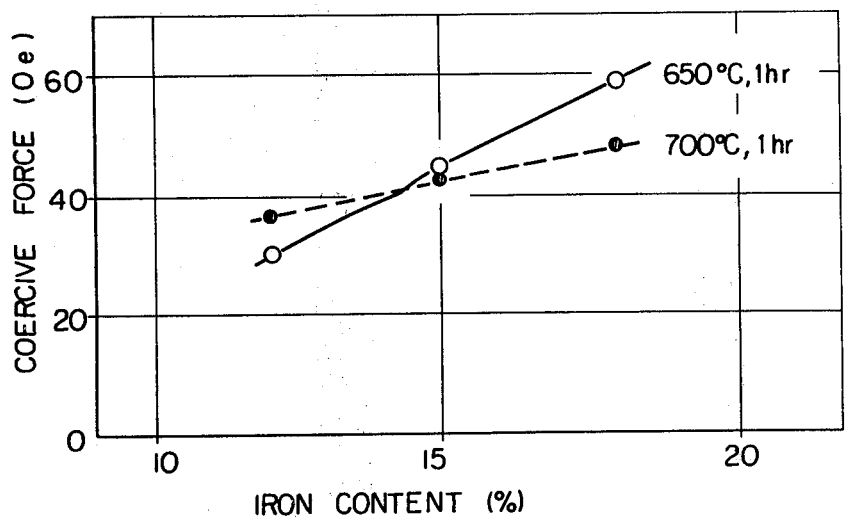

It is clear from FIG. 12, that although the coercive force proportionally increases with the iron content, the residual magnetization is left almost unchanged.

The squareness ratio of the alloy materials produced in the present Example ranged from 90 to 95%.

EXAMPLE 4

The semi-hard magnetic materials having three compositions as shown in Table II were produced by the procedure of Example 1. The measurement results of the magnetic properties are illustrated in Table II.

TABLE II

| Alloy Composition (wt %) | Coercive Force Hc(Oe) | Residual Flux Density Br(KG) | Squareness Ratio Br/Bs | Energy Product $(BxH)_{max}$ | Fullness Factor $(BH)_{max}$ / $BrHc)^{1/2}$ |
|---|---|---|---|---|---|
| Co-16%Fe-4%No-3%Mo | 42 | 13.2 | 0.91 | 380,000 | 0.83 |
| Co-15%Fe-4%No-4%Mo | 61 | 12.2 | 0.90 | 450,000 | 0.78 |
| Co-16%Fe-4%No-5%Mo | 72 | 10.8 | 0.90 | 540,000 | 0.83 |

What we claim is:

1. A semi-hard magnetic material comprising a composition in the following ranges
iron from 12 to 18% by weight,
niobium from 2 to 4%,
molybdenum from 2 to 5%,
cobalt for essentially the balance, and
said material comprising a coercive force above 35 oersteds.

2. A semi-hard magnetic material according to claim 1, wherein said coercive force ranges from 40 to 70 Oe and said residual flux density is not less than 13 kG.

3. A semi-hard magnetic material according to claim 2, wherein said coercive force ranges from 60 to 70 Oe.

4. The material of claim 1 comprising a residual magnetic flux density in the range from 11 to 14 kgauss, a fullness factor of not less than approximately 0.80, and a squareness ratio in the range from 90 to 95%.

5. The material of claim 1 or 4 comprising coercive force between 40 and 70 oersteds.

6. A semi-hard magnetic material according to claim 1 or 4, wherein said iron ranges from 15 to 18%.

7. A semi-hard magnetic material according to claim 1 or 4, wherein said material is suitable for use in a reed switch comprising a four wire crosspoint switch.

8. The material of claim 5 comprising coercive force between 60 and 70 oersteds.

9. The material of claim 1 or 4 having an energy product in the range from 0.3 to 0.6 Mgauss-oersteds.

10. The material of claim 3, 1 or 4 comprising a matrix of the face centered and body centered cubic phases.

11. The material of claim 3, 1 or 4 comprising a matrix of the face centered and body centered cubic phases, and phases of intermetallic compounds precipitated in said matrix.

12. The material of claim 1, 2 or 3 comprising a solid solution of cobalt with iron dissolved in the solid solution, said solid solution comprising a mixture of face and body centered cubic phases, and phases of intermetallic compounds precipitated in said solid solution.

13. A process for producing a semi-hard magnetic material comprising a coercive force above 35 oersteds, residual magnetic flux density above 11 kgauss and a fullness factor of not less than approximately 0.80, said process comprising:

forming a composition comprising iron in the range from 12 to 18% by weight, niobium between 2 and 4% and molybdenum between 2 and 5%, and cobalt in the balance;

solution treating said material;

rapid cooling said solution treated material;

cold working said solution treated material at a reduction of area of at least 90%; and aging said cold worked material at a temperature in the range from 600° to 750° C.

14. A process according to claim 13, wherein the temperature of solution treatment ranges from 1050° to 1200° C.

15. A process according to claim 14, wherein said solution treatment is performed at a temperature of from 1050° to 1150° C.

16. A process according to claim 13, wherein said material is formed to have the coercive force in the range from 40 to 70 Oe and a residual flux density of not less than 11 kG.

17. A process according to claim 16, wherein said material is formed to have the coercive force in the range from 60 Oe.

18. A process according to claim 13, wherein said composition is formed to contain iron in the range from 15 to 18%.

19. A process according to claim 13 or 16, wherein said process further comprises a step of applying a metallic coating on said aged material.

20. The process of claim 15 or 13, said aging resulting in said material simultaneously comprising a mixed phase solid solution of face and body centered cubic structures with intermetallic compounds precipitated therein.

21. The process of claim 13, said cold working resulting in said material having essentially face centered cubic structure and a hardness of less than 450 on the Vickers scale, prior to said aging.

22. The process of claim 13 comprising performing said solution treating for a period in the range from 30 to 60 minutes.

23. The process of claim 13 comprising performing said aging for a period of up to 1 hour.

24. The process of claim 19, said applying of said metallic coating comprising:

removing any oxide film from the surface of said material;

applying a striking layer to said surface of said material for increasing the bonding strength of said metallic coating;

applying said metallic coating onto said striking layer on said material.

25. The process of claim 24, said removing of said oxide film comprising boiling said material in a caustic akaline solution.

26. The process of claim 24, said striking layer comprising gold, and said metallic coating comprising rhodium with thickness between 2.0 and 4.0 microns.

27. The process of claim 26, comprising a lower metallic layer underlying said metallic coating.

28. The process of claim 13, said range for aging being 600° to 730° C.

29. The process of claim 28, said range for aging being from 630° to 660° C.

30. The process of claim 19 comprising forming said material into a reed switch and enclosing said reed switch in a glass capsule.

31. The process of claim 13 comprising at least 15% iron.

* * * * *

UNITED STATES PATENT AND TRADEMARK OFFICE

CERTIFICATE OF CORRECTION

PATENT NO. : 4,300,958

DATED : November 17, 1981

INVENTOR(S) : Yuichi Suzuki et al.

It is certified that error appears in the above—identified patent and that said Letters Patent is hereby corrected as shown below:

Front page, [30] Foreign Application Priority Data, "52-142147" should be --52-142157--;

[57] in the Abstract, at line 1, "Due to an Mo addition," should be --Adding Mo--;

line 2, ", the" should be --allows a high--; delete "is enhanced";

line 3, delete "causing";

line 6, "according to" should be --for--.

In the Figures:

Fig. 1, "AGEING" should be --AGING--.

Figure 7C:
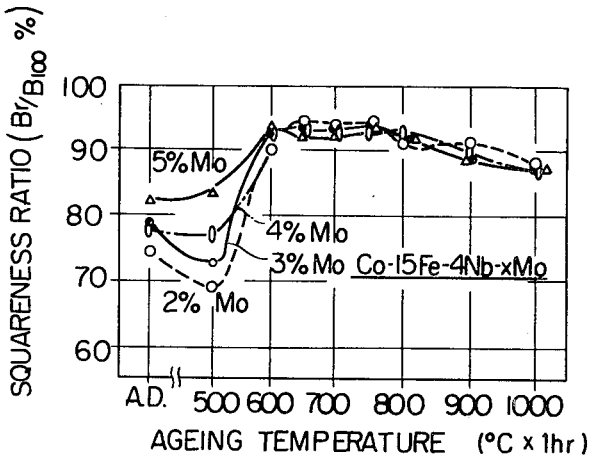

Fig. 7C, "AGEING" should be --AGING.

Fig. 9C, "AGEING" should be --AGING--.

Fig. 10 A, "10" should be --16--.

Figure 11C:
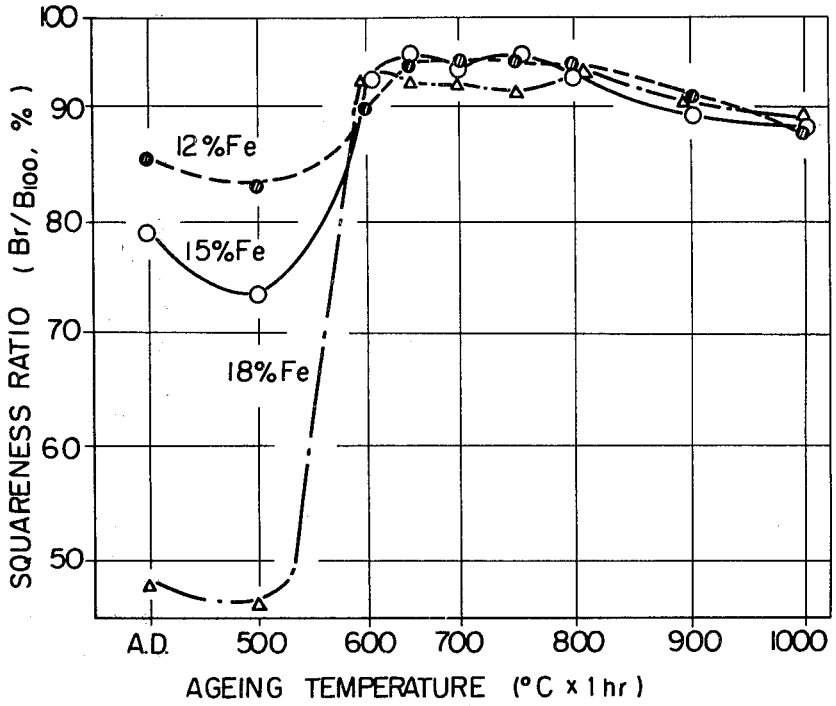

Fig. 11C, "AGEING" should be --AGING--.

Col. 1, line 33, "(Hc" should be --(Hc)--; after "materials" delete ")".

Col. 2, line 63, after "iron" insert --,--.

Col. 3, line 22, "mountd" should be --mounted--;

line 61, make "solution-treating" the beginning of a new paragraph.

Col. 4, line 35, "mateial" should be --material--.

Col. 5, line 2, after "is" insert --,--;

line 37, after "and" delete ";"

line 61, "for exampled" should be --, for example, --.

Col. 6, line 57, after "addition" insert --,--;

line 58, "MG.Oe" should be --MG·Oe--.

Col. 7, line 3, after "resistivity" insert --is--;

line 61, "improved" should be --impaired--;

line 64, "___ ___" should be --___○___--;

line 67, "___ ___" should be --___⊙___--;

UNITED STATES PATENT AND TRADEMARK OFFICE

CERTIFICATE OF CORRECTION

PATENT NO. : 4,300,958

DATED : November 17, 1981

INVENTOR(S) : Yuichi Suzuki et al.

It is certified that error appears in the above—identified patent and that said Letters Patent is hereby corrected as shown below:

line 68, "___ ___" should be --___ 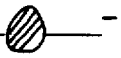 ___--;

Col. 8, line 1, "___ ___" should be --___ 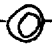 ___--;

line 9, "___ ___ and ___ ___" should be

--___ 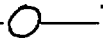 ___-- and ___ 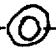 ___--;

line 15, "___ ___" should be --___ 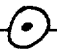 ___--;

line 16, "___)." should be --___ 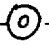 ___).--;

line 56, after "Table I" delete ",".

Col. 9, line 14, "___ ___" should be --___ 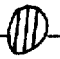 ___--;

line 21, "___ ___" should be --___ 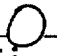 ___--;
line 46, after "70 Oe" insert --,--;
line 55, "each 1" should be --each one--;
line 56, "above-mentioned reed switch 1" should be --respective reed switch--.

Col. 10, line 4, after ", and" insert --are--;
line 44, "so treated" should be --so-treated--;
line 51, "so produced" should be --so-produced--.

Col. 11, line 50, after "materials" insert --is--.

Col. 12, line 3, after "12" delete ",";
in Table II, under heading "Fullness Factor", "$(BH)_{max}$/BrHc) 1/2" should be --($(BH)_{max}$/BrHc)1/2--;
under heading "Alloy Composition," "4% Nc" should be --4% Nb-- at all three occurrences;

UNITED STATES PATENT AND TRADEMARK OFFICE

CERTIFICATE OF CORRECTION

PATENT NO. : 4,300,958

DATED : November 17, 1981

INVENTOR(S) : Yuichi Suzuki et al.

It is certified that error appears in the above—identified patent and that said Letters Patent is hereby corrected as shown below:

Col. 12, line 53, "3, 1 or 4" should be --1,3, or 4--;
line 55, "3, 1 or 4" should be --1, 3 or 4--.
Col. 14, line 16, after "coating;" insert --and--.

Signed and Sealed this

*Seventeenth* Day of *August 1982*

[SEAL]

*Attest:*

GERALD J. MOSSINGHOFF

*Attesting Officer*

*Commissioner of Patents and Trademarks*